United States Patent [19]

Kaptur

[11] Patent Number: 4,875,440

[45] Date of Patent: Oct. 24, 1989

[54] VALVE CONTROL SYSTEM FOR INTERNAL COMBUSTION ENGINES

[76] Inventor: Stephen J. Kaptur, 1841 Dority Blvd., Toledo, Ohio 43615

[21] Appl. No.: 281,662

[22] Filed: Dec. 9, 1988

[51] Int. Cl.[4] ..... F01L 7/08

[52] U.S. Cl. ..... 123/81 B; 123/188 B

[58] Field of Search ..... 123/81 B, 188 B, 188 M, 123/188 R

[56] References Cited

U.S. PATENT DOCUMENTS

| | | | |
|---|---|---|---|
| 1,019,374 | 3/1912 | Shaw | 123/81 B |
| 1,273,002 | 7/1918 | Samuels | 123/81 D |
| 1,374,140 | 4/1921 | Dock | 123/81 B |
| 1,467,742 | 9/1923 | Turner | 123/81 B |
| 1,624,992 | 4/1927 | Spillman | 123/188 B |
| 1,665,421 | 4/1928 | Roose | 123/188 B |
| 1,716,198 | 6/1929 | Trammell | 123/81 B |
| 1,754,647 | 4/1930 | Reeves | 123/188 B |
| 1,781,176 | 11/1930 | Grube | 123/188 B |
| 1,781,901 | 11/1930 | Gamache | 123/81 B |
| 1,818,527 | 8/1931 | Becker | 123/188 B |
| 1,869,633 | 8/1932 | Vang | 123/188 B |
| 1,873,012 | 8/1932 | Moran | 123/188 B |
| 1,899,743 | 2/1933 | Berry | 123/188 B |
| 1,922,678 | 8/1933 | Hallett | 123/188 |
| 1,934,710 | 11/1933 | Hickey | 123/188 |
| 2,028,138 | 1/1936 | Coulling | 123/188 |
| 2,074,487 | 3/1937 | Porter | 123/188 |
| 2,113,519 | 4/1938 | Sloat | 123/188 |
| 2,265,171 | 12/1941 | Johnson | 123/90 |
| 2,302,442 | 11/1942 | Hickey | 123/188 |
| 2,373,924 | 4/1945 | Tompkins | 123/191 |
| 2,409,350 | 10/1946 | Forrest | 123/188 |
| 2,575,394 | 11/1951 | Rice | 309/2 |
| 2,874,686 | 2/1959 | Carey, Jr. | 123/190 |
| 3,277,696 | 10/1966 | Gertel | 73/71.6 |
| 3,439,960 | 4/1969 | Guyon et al. | 308/5 |
| 3,990,423 | 11/1976 | Cruss et al. | 123/190 E |
| 4,098,238 | 7/1978 | Vallejos | 123/81 B |
| 4,201,174 | 5/1980 | Vallejos | 123/188 B |

*Primary Examiner*—Charles J. Myhre
*Assistant Examiner*—Weilun Lo
*Attorney, Agent, or Firm*—David C. Purdue; John C. Purdue

[57] ABSTRACT

An improved intake and exhaust valve system for internal combustion engines is disclosed. The system includes a primary valve control mechanism for sequentially opening and closing the intake and exhaust valves, and a secondary control system for modifying the operation of the primary mechanism. The primary valve control mechanism includes cylindrical cams for opening and closing the intake and exhaust valves. The secondary control system modifies the operation of the primary valve control system to vary the duration, extent and onset of valve opening and closing. The secondary control system includes a control plate, at least one rocker mechanism mounted to sequentially engage and disengage the control plate, and a driver mounted between the rocker mechanism and at least one of the cylindrical cams of the primary control system so that, when the control plate engages the rocker mechanism, the driver mechanism engages one of the cylindrical cams to modify the operation of the primary control system.

5 Claims, 4 Drawing Sheets

VALVE CONTROL SYSTEM FOR INTERNAL COMBUSTION ENGINES

BACKGROUND OF THE INVENTION

1. Field of the Invention

This invention relates to an intake and exhaust valve control system for internal combustion engines. More specifically, the invention is concerned with such a system including a primary control and a variable secondary control.

2. The Prior Art

Conventionally, exhaust and intake valves are opened and closed in timed relationship by a system including a cam shaft and a set of poppet valves, rocker arms, valve lifters and a myriad of associated parts. A given camshaft produces a given valve timing sequence, i.e., the intake and exhaust valves will open at given times, remain open for a predetermined time and close at given times. Changing valve timing in such a system requires the substitution of a new, differently ground cam shaft.

During a search for patents related to the instant invention, the following U.S. Patents were noted: U.S. Pat. Nos. 1,273,002, 1,624,992, 1,665,421, 1,754,647, 1,781,176, 1,818,527, 1,873,012, 1,899,743, 1,922,678, 1,934,710, 2,028,138, 2,074,487, 2,113,519, 2,265,171, 2.373,924, 2,409,350, 3,990,423, 4,098,238 and 4,201,174. U.S. Pat. Nos. 2,575,394, 2,874,686, 3,277,696 and 3,439,960 are the most recent cited references in respect of U.S. Pat. No. 4,201,174.

SUMMARY OF THE INVENTION

The instant invention is based upon the discovery of an improved intake and exhaust valve system for internal combustion engines. The system comprises a primary valve control mechanism for sequentially opening and closing the intake and exhaust valves. The primary valve control mechanism includes cylindrical cams for opening and closing the intake and exhaust valves. The system further comprises a secondary control system for modifying the operation of the primary valve control system to vary the duration, extent and onset of the opening of the valves. The secondary control system includes a control plate, at least one rocker mechanism mounted to sequentially engage and disengage the control plate, and a driver mounted between the rocker mechanism and at least one of the cylindrical cams of the primary control system so that, when the control plate engages the rocker mechanism, the driver mechanism engages one of the cylindrical cams to modify the operation of the primary control system.

DETAILED DESCRIPTION OF THE INVENTION

Figure 2:
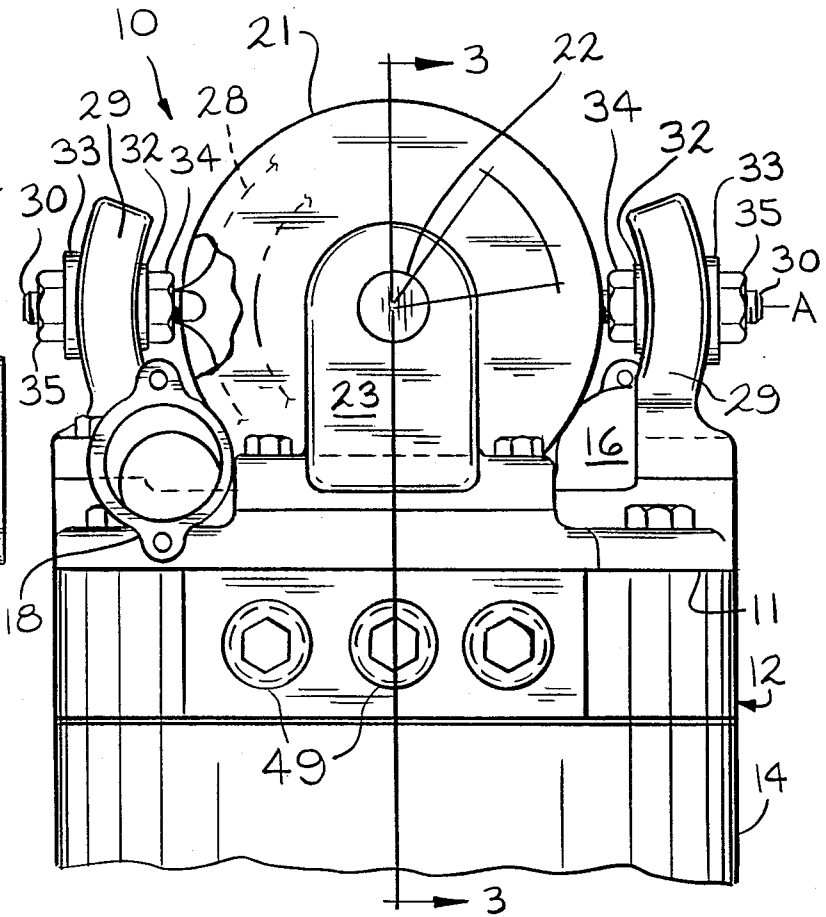
FIG. 2 is a side view of the valve control system illustrated in FIG. 1.
Figure 1:
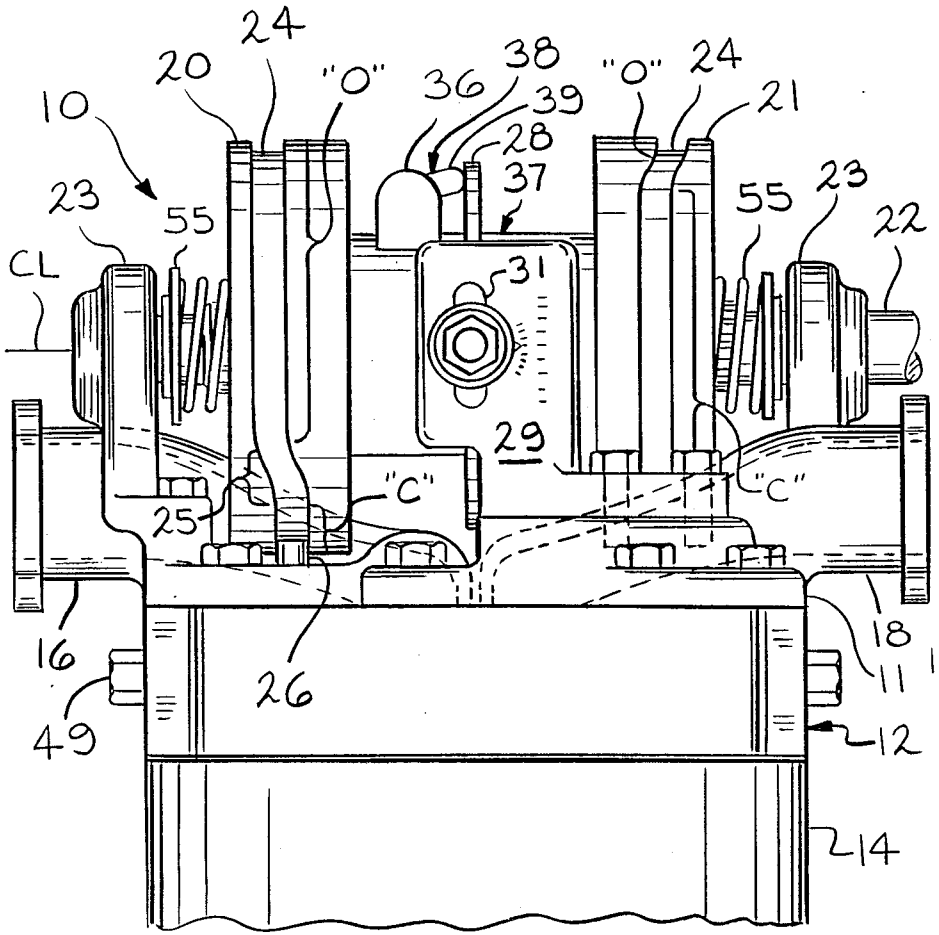
FIG. 1 is a front view of the preferred embodiment of a valve control system, according to the present invention, and an associated cylinder head.

With reference to FIGS. 1 and 2, a valve control system according to the invention is indicated generally at 10. The control system 10 is mounted on a cylinder head 11 of a head assembly 12, which, in turn, is mounted on a cylinder block 14. The head assembly 12 houses valves (discussed below) which are operable to open and close communication between the inside of the cylinder block 14 and, alternatively, an exhaust port 16 and an intake port 18.

The valve control system 10 includes an exhaust cylindrical cam 20 and an intake cylindrical cam 21 mounted on a splined portion of a camshaft 22, for rotation therewith. An aperture (shown in FIG. 7) in the cylindrical cams 20 and 21, through which the splined portion of the camshaft 22 extends, is internally splined to prevent rotation of the cams 20 and 21 relative to the camshaft 22. Thus, the splines on the shaft 22 lock the cams 20 and 21 from rotating relative to the shaft 22 but not against axial movement relative to the shaft 22.

The ends of the camshaft 22 are journaled in camshaft brackets 23 for rotation. The camshaft 22 is preferably driven by conventional timing belt means (not shown) associated with a crank shaft (not shown), at half the rate of rotation of the crank shaft. Because this is a conventional timing mechanism, further discussion and illustration are believed to be unnecessary to a complete understanding of the instant invention.

In the cylindrical cams 20 and 21, there is a portion of a circumferential cam channel 24, designated by reference "O" which, as explained below, is associated with an open valve condition. Another portion of the cylindrical cam channel 24 is associated with a closed valve condition and this portion is designated by reference "C". Between the C portions and the O portions of the cam channels 24 are ramp portions 25.

As the cylindrical cams 20 and 21 rotate, an exhaust valve pin 26 and an intake valve pin 27 (FIG. 3) ride in the cam channels 24 and are sequentially engaged by the C portion, the ramp portion 25, the O portion, the ramp portion 25, the C portion again and so on. As discussed below in connection with FIG. 3, this causes reciprocation of intake and exhaust valves in the cylinder head 12 between open and closed positions.

The remaining discussion of FIGS. 1 and 2 relates to components of a secondary valve control system. The secondary system includes a control plate 28 which is pivotally and rotatably mounted on plate brackets 29 which are, in turn, bolted or otherwise anchored to the cylinder head 11. A pair of plate pins 30 are rigidly connected to the plate 28 and extend outwardly from the plate 28 and through apertures 31 formed in a curved upper portion of the plate brackets 29. Interior washers 32 and exterior washers 33 are carried on the plate pins 30 and may be provided with curved faces to match the curve of the brackets 29. Interior nuts 34 and exterior nuts 35 are threaded onto the pins 30 and serve to lock the plate 28 on the brackets 29 in a desired orientation. The plate 28 can be pivoted about an axis A, which coincides with the centerline of the pins 30. The plate 28, as well as axis A, can be rotated about the center of the plate which, in the illustrated embodiment, coincides with the centerline CL of the camshaft 22. When the plate 28 is in a desired rotational and pivotal orientation, the interior and exterior nuts 34 and 35 can be tightened against the plate brackets 29 thereby locking the plate in the desired position. The function of the plate 28 is discussed below, particularly in connection with FIGS. 3 and 5.

A pair of opposed rocker arm brackets 36 (FIG. 1) are rigidly secured, as by welding or other suitable means, to a central portion 37 of the partially splined camshaft 22. A rocker arm 38 is pivotally supported on the brackets 36. A contact leg 39 of the rocker arm 38 is positioned for intermittent engagement with the control plate 28 and this feature is discussed more fully below. First, the operation of the primary valve control system is discussed with reference to FIG. 3.

A ringed piston 40 is mounted conventionally for reciprocating movement in a cylinder cavity 41 defined by the cylinder block 14. Communication between the cylinder cavity 41 and the exhaust and intake ports 16 and 18 is selectively provided through exhaust and intake passageways 42 and 43 defined in the head assembly 12 and the cylinder head 11. The passageways 42 and 43 are opened or closed depending upon the position of exhaust and intake valve plates 44 and 45, which, in turn, control the position of intake and exhaust cone valves 46 and 47. The valves 46 and 47 are mounted for sliding, reciprocating movement on valve guides 48. One end of each valve guide 48 is mounted in a recess in the head assembly 12 and the other end is fixed in a recess in a threaded valve guide plug 49 which is received in a correspondingly threaded recess in the head assembly 12. Valve return springs 50 are positioned between the valve guide plugs 49 and the intake and exhaust valves 46 and 47. The springs 50 bias the valves 46 and 47 towards a closed position (illustrated) in which they close the passageways 42 and 43. Sealing rings 51 are provided on the valves 46 and 47 to ensure a good closure of the passageways 42 and 43 when the valves 46 and 47 are in the closed position.

The valve pins 26 and 27 are anchored, at one end, in the valves 46 and 47, respectively. The pins 26 and 27 extend upwardly from the valves 46 and 47, through an opening 52 in the head assembly 12, through the valve plates 44 and 45 and through an opening 53 in the cylinder head 11. Reciprocation of the valves 46 and 47 is effected by the rotating cylindrical cams 20 and 21 and, more specifically, by coaction between the valve pins 26 and 27 and the ramp portions 25 of the cam channels 24 in the cylindrical cams 20 and 21. When the valve pins 26 and 27 are engaged in a C portion of the cam channels 24, the pins 26 and 27, the plates 44 and 45 and the valves 46 and 47 will be in the relative positions illustrated in FIG. 3. When the camshaft 22 rotates to a position where, for example, the pin 26 is in the 0 portion of the cam channel of the cylindrical cam 20, the pin 26 will be translated by the intermediate ramp portion 25, to the left, from the position illustrated for it in FIG. 3, and the pin 26 will move the valve plate 44 and the valve 46 to the left, compressing valve return spring 50 and opening the exhaust passageway 42. The passageway 42 will remain open until the camshaft 22 rotates to a position where the next sequential ramp portion 25 of the cam channel 24 in the cylindrical cam 20 again engages the pin 26. Such engagement will cause the pin 26, the valve plate 44 and the valve 46 to return to the position illustrated in FIG. 3, closing the passageway 42. As the camshaft 22 continues to rotate, a similar sequence of opening and closing is effected by the cylindrical cam 21 relative to the pin 27, the plate 45 and the valve 47. Further rotation of the camshaft 22 begins the entire sequence over again.

It will be understood that, except under the influence of the secondary control system discussed below, as the cylindrical cams 20 and 21 rotate, they will remain fixed, axially, on the camshaft 22, adjacent to the central portion 37 of the camshaft 22. Cam springs 55 urge the cylindrical cams 20 and 21 toward the central portion 37 of the camshaft 22 by reacting against washers 56 which abut split rings 57 which are locked, axially, in circumferential grooves 58 formed in the camshaft 22. The central portion 37 of the camshaft 22 has a larger diameter than the adjacent splined portions. Accordingly, the cams 20 and 21, or, as discussed below, push bars 65, abut the central portion 37 of the camshaft 22 to restrict axial movement of the cams 20 and 21 towards one other.

The operating parameters of the primary control system are determined by the configuration of the cam channels 24 and the angular orientation of the cylindrical cams 20 and 21 relative to the camshaft 22 and each other. The exhaust and intake valves 46 and 47 will remain open for a period of time which is a direct function of the length of the O portion of the cam channels 24 in the cylindrical cams 20 and 21, and the rate of rotation of the camshaft 22.

Similarly, the exhaust and intake valves 46 and 47 will remain closed for a period of time which is a direct function of the length of the C portion of the cam channels 24 in the cylindrical cams 20 and 21, and the rate of rotation of the camshaft 22.

The timing of valve opening and closing can be controlled by controlling the positions of the ramp portions 25 in the cam channels 24 of the cylindrical cams 20 and 21. The timing of valve opening and closing can be adjusted, for a given cylindrical cam configuration, by changing the angular position of the cylindrical cam on the partially splined camshaft 22. It is well within the province of those skilled in this art to configure operable cam channels for a pair of cylindrical cams and to position those cylindrical cams on a splined portion of a camshaft so that the primary control system will open and close intake and exhaust valves at appropriate times during the operation of an engine on which the system is mounted. It would be advantageous, in a system according to the present invention, to configure the cam channels 24 to provide valve open conditions of the shortest duration that would be operable in a given engine, because the secondary system described below is operable to increase the duration, when desired, of an open valve condition.

Figure 4:
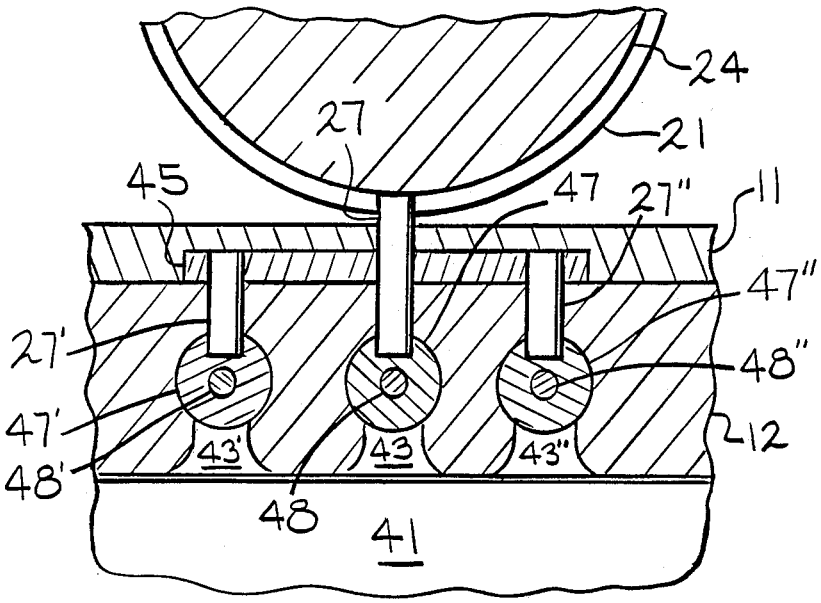
FIG. 4 is a cross sectional view taken along the line 4—4 of FIG. 3 and illustrating the valves controlled by the system of the instant invention.

It may desirable, in order to conserve space, to reduce the thickness of the head assembly as much as possible. To this end, it may be desirable to provide a plurality of intake and exhaust valves in the head assembly. Illustrative of this concept are intake valves 47, 47' and 47'' shown in FIG. 4. The valves 47, 47' and 47'' are mounted for sliding reciprocating movement on valve guides 48, 48' and 48'', respectively, between a first position in which they close and a second position in which they do not close intake passageways 43, 43' and 43", respectively. The valves 47, 47' and 47" are interconnected by the valve plate 45 and valve pins 27, 27' and 27" so that all of the valves reciprocate in unison. This arrangement is also to advantage in that, together, the valves 47, 47' and 47" weigh less than would a single valve that was sized to fit a passageway having a cross sectional area corresponding with the total cross sectional area of passageways 43, 43' and 43".

Figure 3:
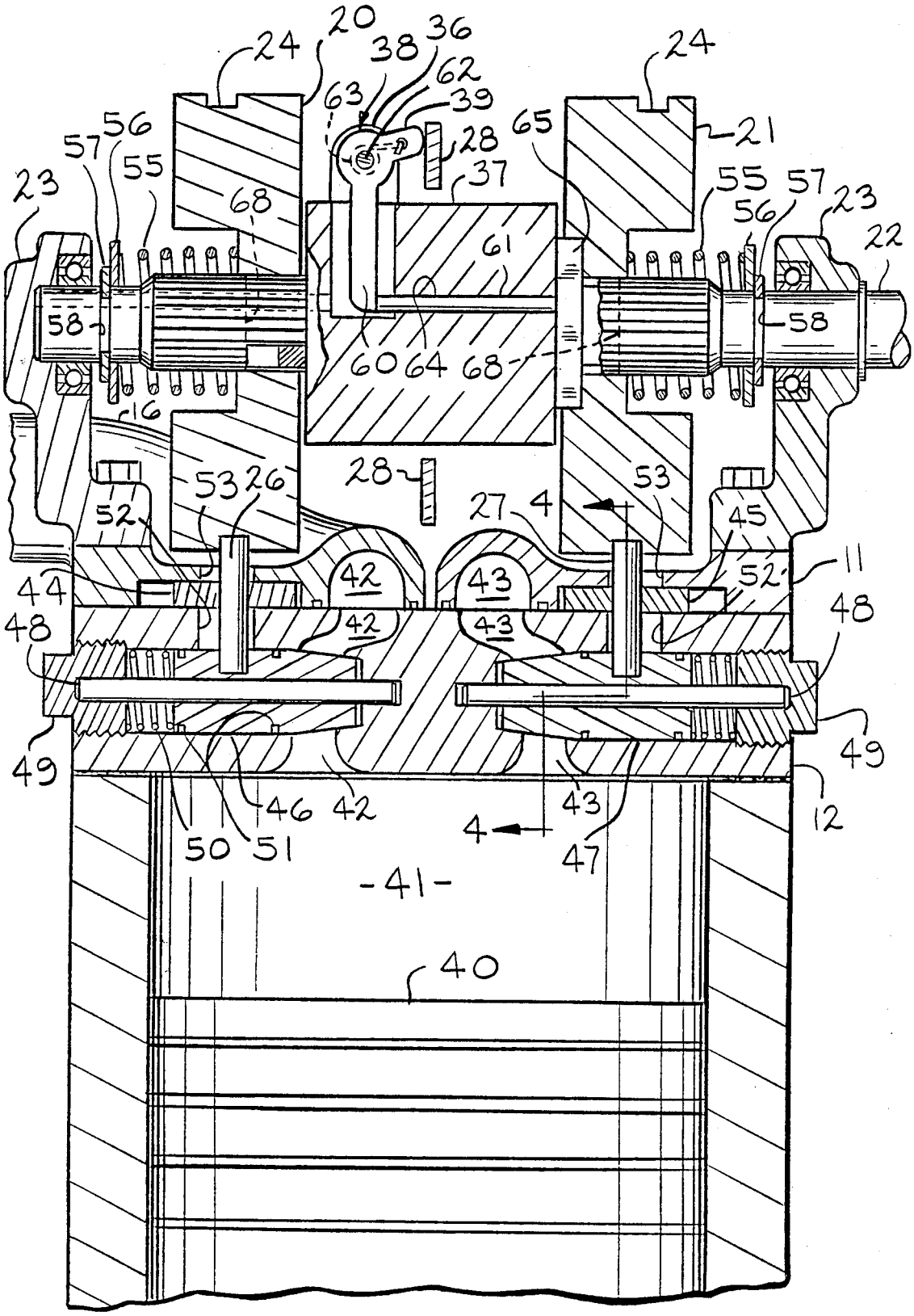
FIG. 3 is a sectional view of the valve system taken along the line 3—3 of FIG. 2.

With further reference to FIG. 3, components of a secondary valve control system are positioned between the cylindrical cams 20 and 21. The control plate 28 has already been described with reference to FIGS. 1 and 2, as have the rocker arm brackets 36, the rocker arm 38 and the contact leg 39 of the rocker arm 38. The rocker arm 38 further comprises a driver leg 60 which is normally in contact with one end of a driver 61. The rocker arm 38 is mounted for limited pivoting movement about a rocker arm pin 62 which is anchored at both ends in the rocker arm brackets 36. A spring 63 is provided to lightly bias the driver leg 60 of the rocker arm 38 into contact with the driver 61. The driver 61 is positioned in an axially extending bore 64 between the driver leg 60 and a push bar 65 which is anchored in the cylindrical cam 21.

Figure 7:
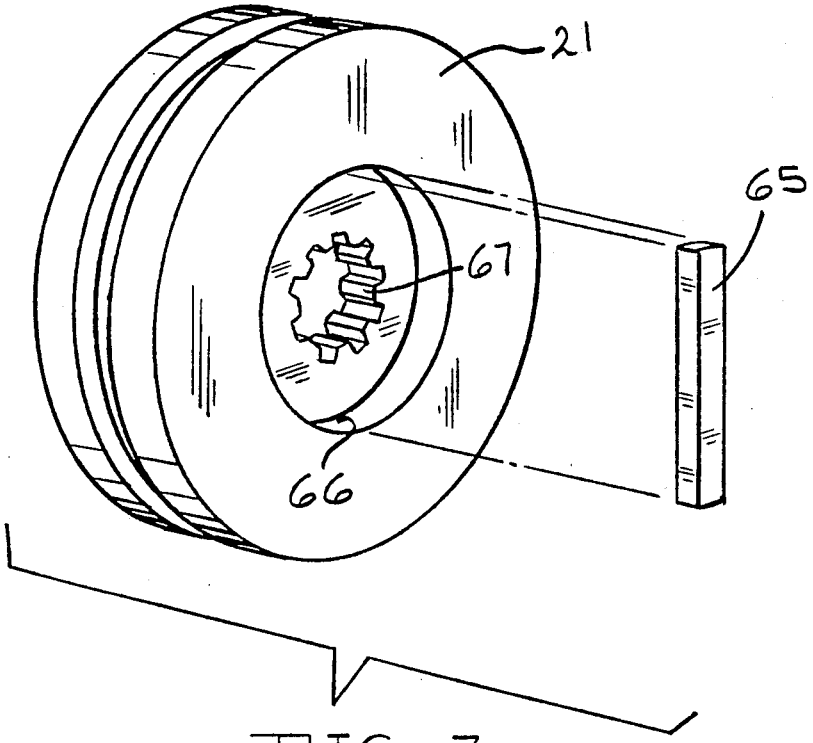
FIG. 7 is a exploded perspective view of a cylindrical cam and push bar assembly.

With reference to FIG. 7, the push bar 65 is received inside a shoulder 66 in the cylindrical cam 21. Also shown in FIG. 7 is the splined aperture 67 in the cylindrical cam 21. The splined aperture 67 is received on the splined portion of the camshaft 22. The push bar 65 extends through a keyway 68 (FIG. 3) in the camshaft 22. The width of the keyway 68 is sized to provide substantial clearance for the push bar 65. The axial extent of the keyway 68 is enough to provide clearance for substantial axial movement of the cylindrical cam 21 and the push bar 65 on the camshaft 22.

As shown in FIG. 3, the push bars 65 abut the central section 37 of the camshaft 22. When, under the influence of cam springs 55, the cylindrical cams 20 and 21 are positioned so that the push bars 65 abut the central portion 37 of the camshaft 22, the valve 46 or 47 will be in a closed position when the corresponding pin 26 or 27 is in a C portion of the corresponding cylindrical cam 20 or 21. Wear on the parts of the primary valve control system and the valves themselves may prevent complete seating of the valves 46 and 47 when the foregoing conditions prevail. This wear can be compensated for by the substitution of a push bar 65 with a thickness that is less than the thickness of the original push bar 65, the difference in thickness being such that the valve 46 or 47 seats completely when the corresponding valve pin 26 or 27 is in the C portion of the corresponding cam 20 or 21.

Returning now to the secondary control system, a review of FIG. 3 shows that, if the plate 28 was displaced to the left from the position illustrated for it, the plate 28 would contact the rocker arm 38, causing it to pivot about the rocker arm pin 62, thereby displacing the driver leg 60 of the rocker arm 38 to the right. This displacement would be transmitted through the driver 61, through the push bar 65, to the cylindrical cam 21. Thus, such pivoting of the rocker arm 38 will displace the cylindrical cam 21 to the right in FIG. 3, compressing the cam spring 55. Such displacement of the cylindrical cam 21 would correspondingly displace the pin 27 and the valve 47 to the right. In this way, the secondary control system modifies the operation of the primary valve control system.

Figure 5:
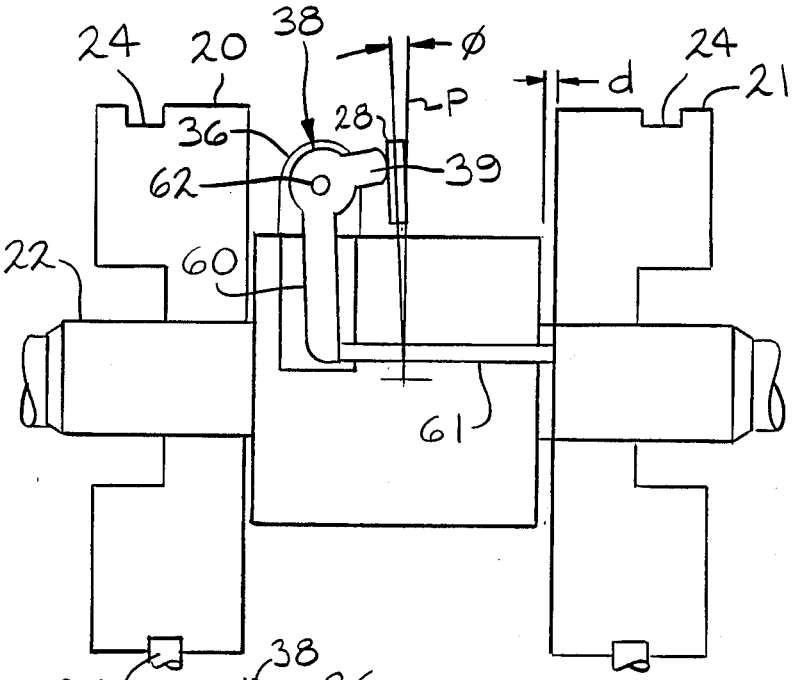
FIG. 5 is a partial, schematic view of the system which illustrates the operation of the secondary control system.

In FIG. 5, the plate 28 is illustrated in a position in which it forms an angle $\phi$ relative to a plane P which is perpendicular to the camshaft 22. The plate 28 can be locked in this position by the nuts 34 and 35 (FIG. 2). The rocker arm 38 is positioned so that, as it rotates with the central portion 37 of the camshaft 22 past the upper half of the plate (180°) 28, the contact leg 39 will be displaced to the left an amount which will increase over the first 90° to a maximum displacement at 90° and decrease over the remaining 90° to zero displacement. Accordingly, over the first 90°, the cylindrical cam 21 will be positively displaced, towards the right, up to a maximum amount d, by coaction between the plate 28, the rocker arm 38, the driver 61 and the push bar 65. Over the second 90°, the displacement d of the cylindrical cam 21 will decrease under the positive action of the cam spring 55, until it reaches zero and the push bar 65 bottoms out on the central portion 37 of the camshaft 22. It is apparent from FIG. 5 that, as the angle $\phi$ increases, so will the magnitude of d. Of course, displacement, to the right, of the cylindrical cam 21 correspondingly displaces the valve pin 27 and the corresponding valve 47 to the right, towards an open position. The onset of this displacement can be advanced or retarded by appropriately rotating the plate 28 about the centerline CL of the camshaft 22.

As the rocker arm 38 rotates past the second 90° of the upper half of the plate 28, the rocker arm will pivot back to a neutral position under the influence of the cam spring 55 acting through the cam 21, the push bar 65, the driver 61 and the driver leg 60 of the rocker arm 38. As the rocker arm rotates past the lower half (180°) of the plate 28, the contact leg 39 will not be displaced by contact with the plate 28, but will remain in a neutral position under the action of the spring 63, which biases the driver leg 60 of the rocker arm 38 towards the driver 61. The cycle will repeat as the rocker arm 38 rotates past the upper half of the plate 28 again.

Figure 8:
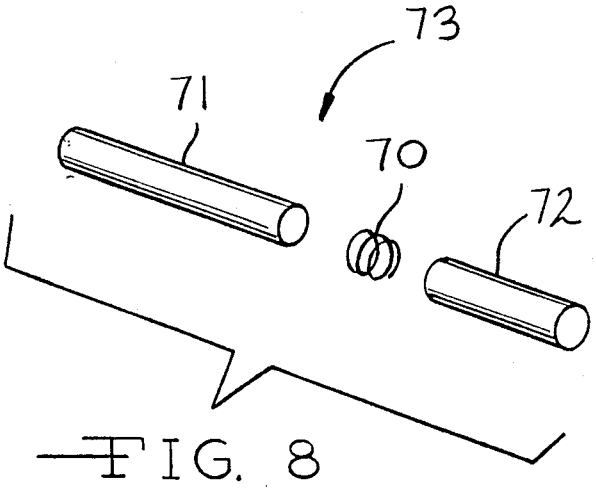
FIG. 8 is a perspective view of an alternative embodiment of a driver for use in the present control system.

In the case where it is desired to have the secondary system operate over less than 180° of camshaft 22 rotation, take up means may be inserted in the linkage consisting of the plate 28, the rocker arm 38, the driver 61 and the push bar 65. For example, with reference to FIG. 8, a short spring 70 may be inserted in line between a left half 71 and a right half 72 of a composite driver 73. The spring 70 would have to have to have a smaller spring constant than the cam spring 55 so that the spring 70 will compress before the cam spring 55. Accordingly, as the rocker arm pivots and the driver arm 60 displaces the left half 71 of the composite driver 73 to the right, the spring 70 will be compressed, until it is completely compressed, whereupon it will transmit further displacement of the left half 71 of the composite driver 73 to the right half 72. The amount by which the spring 70 can be compressed, call it X, would be less than d, FIG. 5, so that the resultant maximum displacement of the cam 21 would be d minus X.

Figure 6:
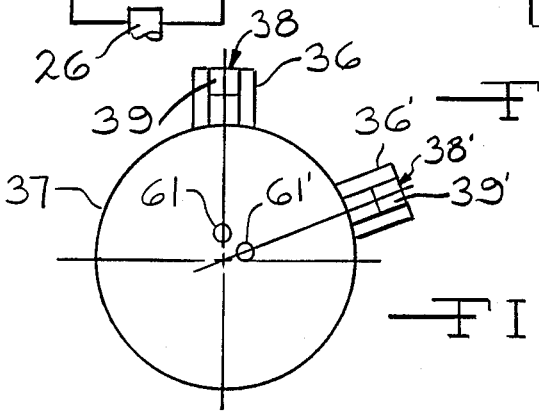
FIG. 6 is a schematic view illustrating the respective angular orientations of drivers in the secondary control system.

Although a secondary control has been described only in respect of the intake cam 21, it will be appreciated that a corresponding control can be provided for the exhaust cam 20. Generally, intake would lead exhaust by approximately 110° of camshaft rotation. In the present system, however, the intake and exhaust valves open in opposite directions which effectively skews the conventional relationship between intake and exhaust by 180° of camshaft rotation. Accordingly, the exhaust will lead the intake by 70° of camshaft rotation. This relationship is illustrated in FIG. 6 where the intake driver 61 is approximately 70° of counter-clockwise camshaft rotation behind an exhaust driver 61'. The exhaust driver 61' is operatively associated with a rocker arm 38' which is mounted on brackets 36', on the opposite side of the plate 28 from the rocker arm 38.

Those skilled in the art will appreciate that there are several alternatives to the manual adjustment of the control plate 28 described above. For example, known servo control means could be utilized to adjust the pivotal or rotational orientation of the plate 28. Similarly, vacuum control could easily be incorporated into the control system of the instant invention to activate the secondary control system, and increase the angle of the plate 28, in response to power demands on the associated engine and to decrease the angle $\phi$ of the control plate when those demands aren't present.

Although the invention has been described with reference to a single cylinder of an engine, it can readily be incorporated in multiple cylinder engines. Specific lubrication systems for the components of the valve control system may be incorporated. Alternatively, carbon impregnated, self-lubricating metals or teflon coated parts may be utilized where oil lubrication would be impractical.

The foregoing description sets forth the best mode presently known for practicing the instant invention and is intended to enable those skilled in the art to practice it. Modifications and alterations, other than those specifically suggested, may occur to those skilled in the art but fall, nonetheles, within the spirit and scope of the appended claims.

I claim:

1. A valve control system for an internal combustion engine, said system comprising a primary control and a secondary control for modifying the operation of the primary control, said primary control comprising:

a camshaft journaled for rotation in camshaft brackets, intake and exhaust cylindrical cams mounted on, for rotation with, the camshaft, said cams including cam channels, valve pin means, connectable to valves in the associated engine, for cooperating with the cam channels in said cylindrical cams to translate rotation of the cylindrical cams into a pattern of controlled reciprocation of the valves and timing belt means for imparting rotation to the camshaft from a rotatable part of the engine, said secondary system comprising control plate means adjustably mounted between said cylindrical cams, rocker arm means mounted on said camshaft for rotation therewith, said last named means including a contact leg and a driver leg, said contact leg being positioned to selectively contact said control plate means during rotation of said camshaft, wherein such contact displaces said driver leg of said rocker arm means, and at least one driver positioned between said driver leg and one of said cylindrical cams, said driver being operable, when the driver leg is in contact therewith, to transmit displacement of the driver leg to one of said cylindrical cams thereby modifying the pattern of controlled reciprocation of at least one of the valves.

2. The valve control system claimed in claim 1 wherein said control plate means can be adjusted pivotally and rotatably with respect to said camshaft.

3. The valve control system claimed in claim 1 wherein, displacement of the driver leg of the rocker arm means is translated into axial movement of one of the cylindrical cams, relative to the camshaft.

4. A valve control system for an internal combustion engine, said system comprising a primary control and a secondary control for modifying the operation of the primary control, said primary control comprising:

a camshaft journaled for rotation in camshaft brackets, said camshaft including a central portion positioned between two splined portions, intake and exhaust cylindrical cams mounted on, for rotation with, the splined portion of said camshaft, said cams including cam channels, valve pin means, connectable to valves in the associated engine, for cooperating with the cam channels in said cylindrical cams to translate rotation of the cylindrical cams into a pattern of controlled reciprocation of the valves and timing belt means for imparting rotation to the camshaft from a rotatable part of the engine, said secondary system comprising control plate means adjustably mounted between said cylindrical cams, first and second rocker arms mounted on said camshaft for rotation therewith, said rocker arms each including a contact leg and a driver leg, said contact legs being positioned to selectively and sequentially contact said control plate means during rotation of said camshaft, wherein such contact displaces said driver leg of said rocker arms, and first and second drivers positioned between said driver leg and said intake and exhaust cylindrical cams, said drivers being operable, when the driver leg is in contact therewith, to transmit displacement of the driver leg to one of said cylindrical cams thereby modifying the pattern of controlled reciprocation of at least one of the valves.

5. An internal combustion engine and an intake and exhaust valve control system therefore, said engine comprising at least one intake cone valve and at least one exhaust cone valve, said valves being mounted for reciprocating movement between a first closed position and a second open position, said valve control system comprising a primary control and a secondary control for modifying the operation of the primary control, said primary control comprising:

a camshaft journaled for rotation in camshaft brackets supported on said engine, said camshaft including a central portion positioned between two splined portions, intake and exhaust cylindrical cams mounted on, for rotation with, the splined portions of said camshaft, said cams including cam channels, valve pin means connected to said intake and exhaust valves in the engine, for cooperating with the cam channels in said cylindrical cams to translate rotation of the cylindrical cams into a pattern of controlled reciprocation of the intake and exhaust valves between the first and second positions, and timing belt means for imparting rotation to the camshaft from a rotatable part of the engine, said secondary system comprising control plate means adjustably mounted between said cylindrical cams, first and second rocker arms mounted on said camshaft for rotation therewith, said rocker arms each including a contact leg and a driver leg, said contact legs being positioned to selectively and sequentially contact said control plate means during rotation of said camshaft, wherein such contact displaces said driver leg of said rocker arms, and first and second drivers positioned between said driver leg and said intake and exhaust cylindrical cams, said drivers being operable, when the driver leg is in contact therewith, to transmit displacement of the driver leg to one of said cylindrical cams thereby modifying the pattern of controlled reciprocation of at least one of said valves.

* * * * *